US006070868A

United States Patent [19]

Nagato et al.

[11] Patent Number: 6,070,868

[45] Date of Patent: Jun. 6, 2000

[54] SPACE SAVING DOCUMENT TRANSPORT DEVICE HAVING EXTENDABLE FEED TRAY

[75] Inventors: Hiroyasu Nagato; Akiyoshi Johdai, both of Toyokawa; Tohru Marakami, Okazaki, all of Japan

[73] Assignee: Minolta Co., Ltd., Osaka, Japan

[21] Appl. No.: 08/937,465

[22] Filed: Sep. 25, 1997

[30] Foreign Application Priority Data

Sep. 27, 1996 [JP] Japan ..... 8-277048

[51] Int. Cl.[7] ..... B65H 1/26

[52] U.S. Cl. ..... 271/145; 271/162; 271/171; 271/161; 271/223

[58] Field of Search ..... 271/145, 162, 271/171, 161, 223

[56] References Cited

U.S. PATENT DOCUMENTS

| | | | |
|---|---|---|---|
| 5,367,370 | 11/1994 | Yoshida et al. | 271/162 X |
| 5,832,356 | 11/1998 | Kurando et al. | 271/145 X |

FOREIGN PATENT DOCUMENTS

| | | | |
|---|---|---|---|
| 32569 | 3/1978 | Japan | 271/161 |
| 244719 | 12/1985 | Japan | 271/145 |
| 116426 | 5/1987 | Japan | 271/145 |
| 278868 | 10/1993 | Japan | 271/171 |
| 9066 | 1/1994 | Japan | 271/171 |
| 06032467 | 2/1994 | Japan . | |
| 06032472 | 2/1994 | Japan . | |
| 06080294 | 3/1994 | Japan . | |

*Primary Examiner*—William E. Terrell
*Assistant Examiner*—Richard Ridley
*Attorney, Agent, or Firm*—McDermott, Will & Emery

[57] ABSTRACT

A document transport device provided with a document tray comprising a main tray and a foldable auxiliary tray disposed above a discharge tray. A document transport device provided with a projection and a projection on an auxiliary tray to guide ejected sheets to a discharge tray without buckling or bending at the gap and height differential at the order between a main tray and an auxiliary tray, and to allow both large size document and small size documents to be easily removed from a document tray.

14 Claims, 8 Drawing Sheets

SPACE SAVING DOCUMENT TRANSPORT DEVICE HAVING EXTENDABLE FEED TRAY

BACKGROUND OF THE INVENTION

1. Field of the Invention

The present invention relates to a document transport device, and specifically relates to a document transport device provided with a discharge tray to receive ejected documents and disposed below a document feed tray (document tray) accommodating stacked documents.

2. Description of the Related Art

Document transport devices have been proposed which can be installed in a narrow space by arranging a feed tray and a discharge tray one above another in a vertical direction so as to avoid having the feed tray extend beyond the side of the device. In such document transport devices, a document in the feed tray passes through a first U-turn and is inverted and placed on a document table, and after predetermined processing such as optical exposure on said document table and the like, said document is transported in the same direction as during the initial feeding and passes through a second U-turn and is inverted and ejected to a discharge tray at a position below said feed tray.

The aforesaid document transport device is disadvantageous inasmuch as the feed tray and the discharge tray are arranged one over another in a vertical direction such that the majority of the discharge tray is covered and concealed by the feed tray, making it difficult to manually remove documents stacked on the discharge tray. This difficulty is magnified particularly in the case of small size documents. Therefore, consideration has been given to facilitate easy removal of documents by exposing part of the discharge tray (i.e., the part from the second U-turn) by shortening the length of the feed tray in the document transport direction. Simply shortening the length of the feed tray, however, produces another disadvantage inasmuch as large size documents cannot be stacked on the feed tray.

Accordingly, it has been proposed to construct a feed tray capable of being folded at a predetermined part (e.g., the center part) in the document transport direction, such that small size documents are exposed on the discharge tray by folding up the aforesaid folding part of the feed tray to allow easy document removal, and large size documents can be accommodated on the feed tray by opening the aforesaid folding part of the feed tray. It has further been proposed to construct a feed tray comprising a main tray wherein the edge on the leading edge side is connected to the entrance to the aforesaid first U-turn path, and an auxiliary tray is mounted on the edge of said main tray on the trailing edge side and is foldable so as to be overlaid on the top surface of said main tray. In this instance, "leading edge" refers to the direction of document transport, and "trailing edge" refers to the opposite direction.

From the perspective of operational characteristics when placing a document as well as preventing an increase in the size of the document transport device, there is a tendency to construct a thin feed tray. It is therefore difficult to form sufficient concavoconvexity of the surface of the feed tray, which results in difficulty manually removing document placed on the feed tray when said documents are of a size that is smaller than the feed tray. Although consideration has been given to dividing the feed tray into a plurality of foldable parts to eliminate this disadvantage, such an arrangement not only complicates the mechanism of the auxiliary tray, but also produces a further disadvantage of complicating the operation of opening and closing the auxiliary tray.

When a feed tray comprises a main tray and an auxiliary tray capable of folding as previously described, a height differential and gap are produced on the back surface (bottom surface) of the folding part, such that the leading edge of a sheet passing through said second U-turn path and discharged to the discharge tray becomes caught by the height differential or gap so as to be bent or damaged. Furthermore, when such bending causes disruption of the document on the discharge tray, problems such as jamming of a subsequently discharged document readily occur. A further disadvantage is the particularly common occurrence of upward curling of the edges of a document on the tray when a document is discharged onto the discharge tray.

OBJECTS AND SUMMARY

An object of the present invention is to provide a feed tray divided into a main tray and auxiliary tray so as to be foldable to allow easy manual removal of small size documents set on the feed tray without increasing the number of divisions of the auxiliary tray and which prevents the problem of having the leading edge of a document ejected to the discharge tray becoming caught in the area of height differential between said main tray and auxiliary tray even when the feed tray has a thin construction.

These objects are attained by providing a feed tray for use in a document transport device which transports a document on a feed tray through a first U-turn path and onto a document table positioned below said feed tray, and thereafter transports said document in the same direction through a second U-turn and deposits said document in a discharge tray positioned above said document table and below said feed tray, said feed tray comprising a main tray having an edge on the leading edge side connected to the entrance of said first U-turn path, and an auxiliary tray mounted on the edge of the trailing edge side of said main tray so as to be foldable onto the top surface of said main tray, wherein said auxiliary tray has a back surface provided with a projection to lift a document from said back surface wwhen the auxiliary tray is in a folded state, and to guide the leading edge of a document ejected from said second U-turn path to said discharge tray when the auxiliary tray is in an open state.

The present invention provides a document transport device which transports a document on a feed tray through a first U-turn path and onto a document table positioned below said feed tray, and thereafter transports said document in the same direction and through a second U-turn and deposits said document in a discharge tray positioned above said document table and below said feed tray, said feed tray comprising a main tray having an edge on the leading edge side connected to the entrance of said first U-turn, and an auxiliary tray mounted on the edge on the trailing edge side of said main tray so as to be foldable onto the top surface of said main tray and having a projecting part on the surface accommodating documents when in the folded state, wherein said auxiliary tray is provided with a projection to guide the leading edge of a document ejected from said second U-turn path to said discharge tray when in the auxiliary tray is in a folded state, and supports the open angle of said auxiliary tray at a predetermined angle by abutting a corresponding position on the back surface of said main tray when the auxiliary tray is in an open state.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 6(*b*) is an enlargement of the essential part showing auxiliary tray 25 in the folded state;

FIG. 7(*b*) shows auxiliary tray 25 in an open state in another embodiment.

DESCRIPTION OF THE PREFERRED EMBODIMENTS

The preferred Embodiments of the present invention are described hereinafter with reference to the accompanying drawings.

Figure 1:
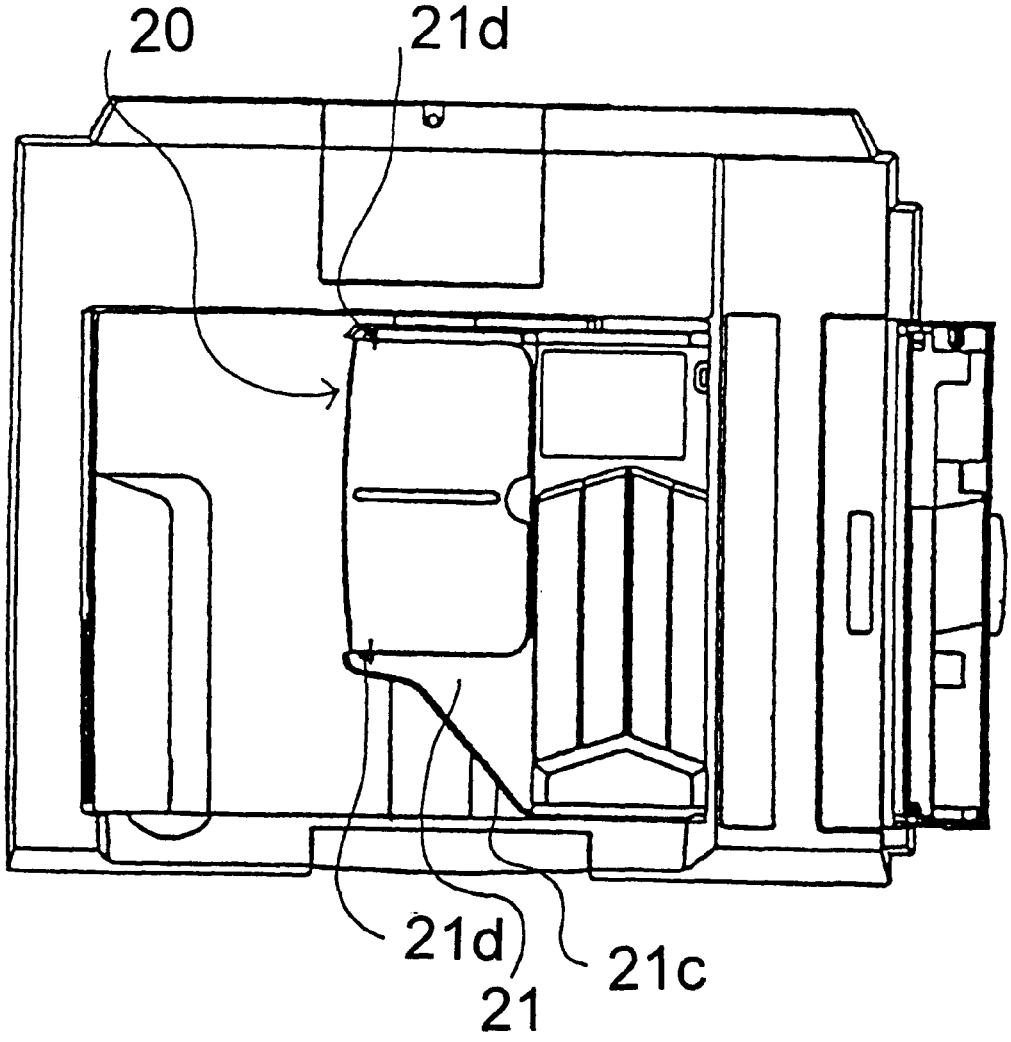
FIG. 1 is a top view of a document transport device.
Figure 2:
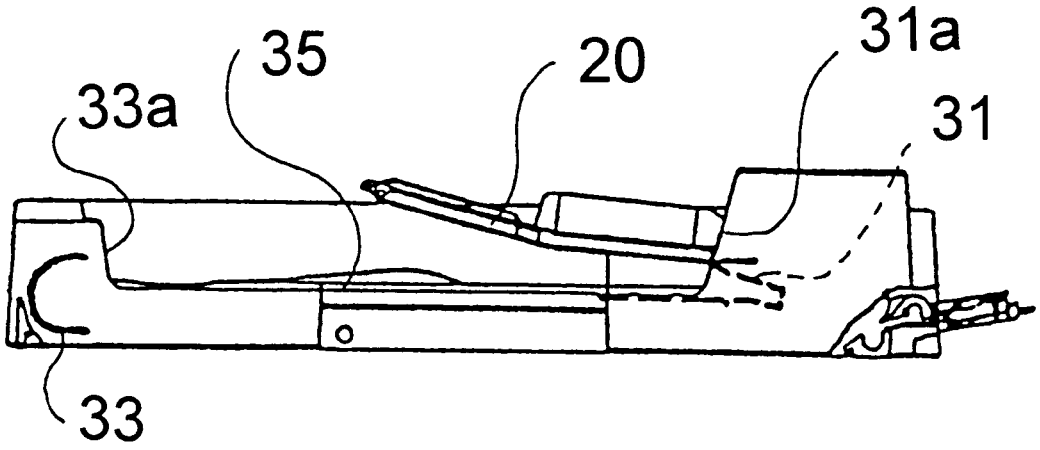
FIG. 2 is a front view of a document transport device.

FIG. 1 is a top view showing the general construction of a document transport device, and FIG. 2 is a front view of same. The document transport device shown in the drawings is a so-called auto document feeder (ADF). The bottom-most document in a stack of documents placed with the image surface facing upward on document tray 20 is sequentially fed therefrom by a take-up roller, guided by guide 31 and the like comprising a first U-turn path, and placed at a predetermined position on a document table (e.g., the document table of a copying machine) directly below the document transport device via intermediate rollers. Then, when optical scanning (predetermined processing) of the document on the document table is completed, the document is transported in the same direction as when fed (i.e., leftward from the top of the document table in the drawing), so as to pass through a second U-turn comprising guide 33 and the like at a position at the end of the transport direction (left side of the drawing), and is ejected onto discharge tray 35.

The discharge tray 35 is provided at a position adjacent to the outlet 33*a* of the second U-turn path at the top surface of the document transport device (i.e., at the left side of the drawing). The position of the discharge tray 35 is below the document tray 20. The extension of document tray 20 from the side of the body of the document transport device is avoided by disposing the discharge tray 35 below the document tray 20 and positioning the document table (i.e., a member for predetermined processing) below said discharge tray 35 so as to transport and invert a document by passing through said first and second U-turn paths. In other words, the document transport device can be installed in a narrow space.

Figure 3:
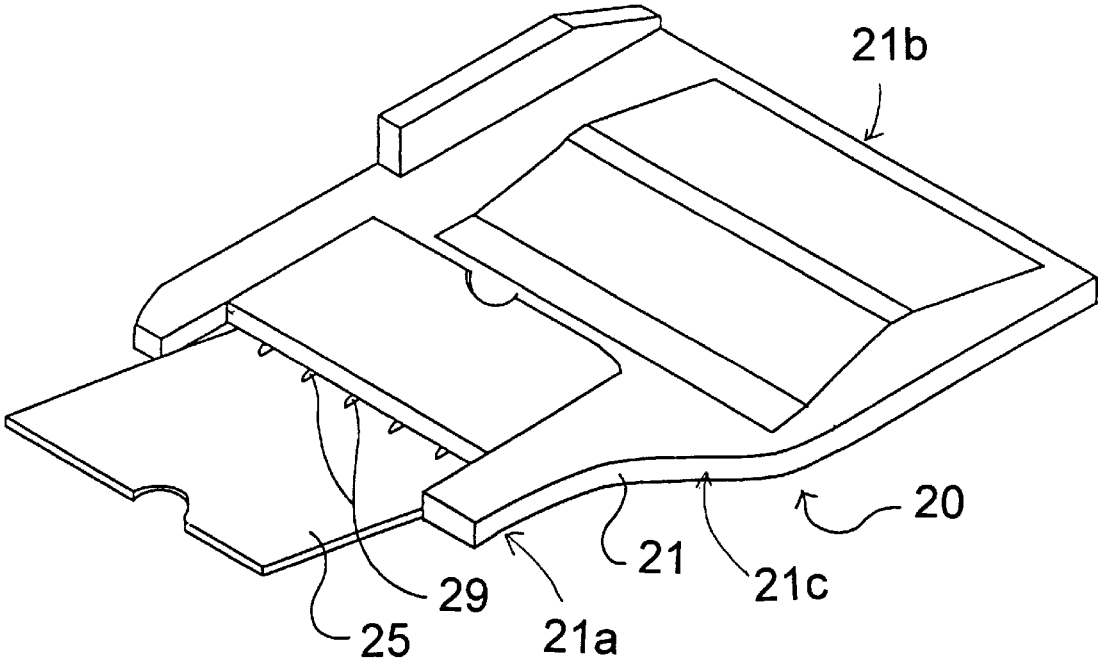
FIG. 3 is a perspective view of paper tray 20 of a document transport device.
Figure 4:
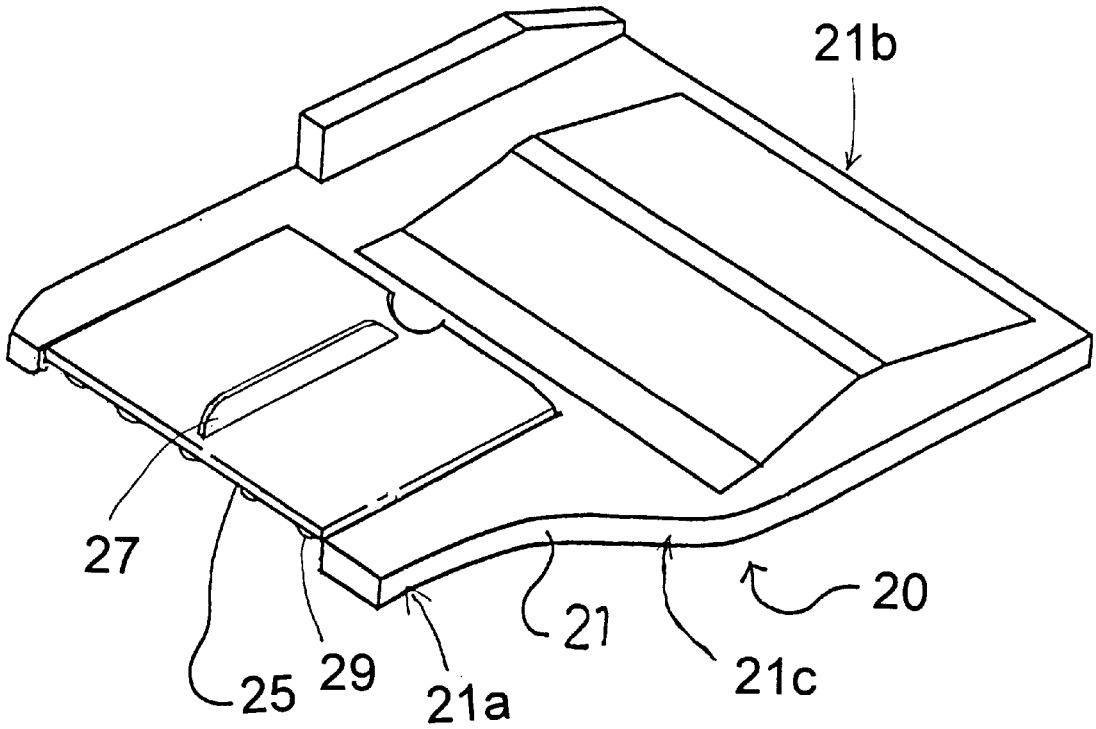
FIG. 4 is a perspective view of auxiliary tray 25 in a folded state on the top surface of main tray 21 of paper tray 20 of a document transport device.
Figure 5:
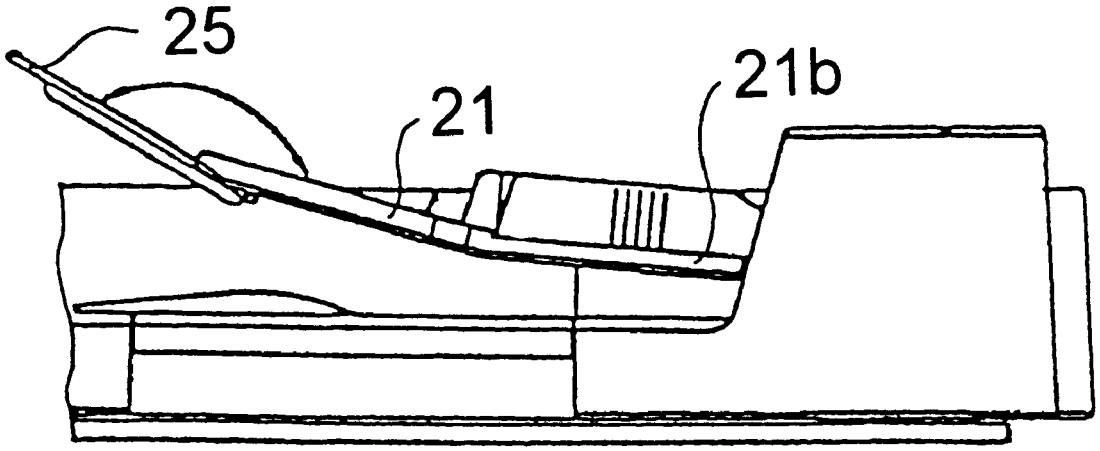
FIG. 5 is a vertical section view of the essential part of paper tray 20 with auxiliary tray 25 in an open state in the document transport device.
Figure 6A:
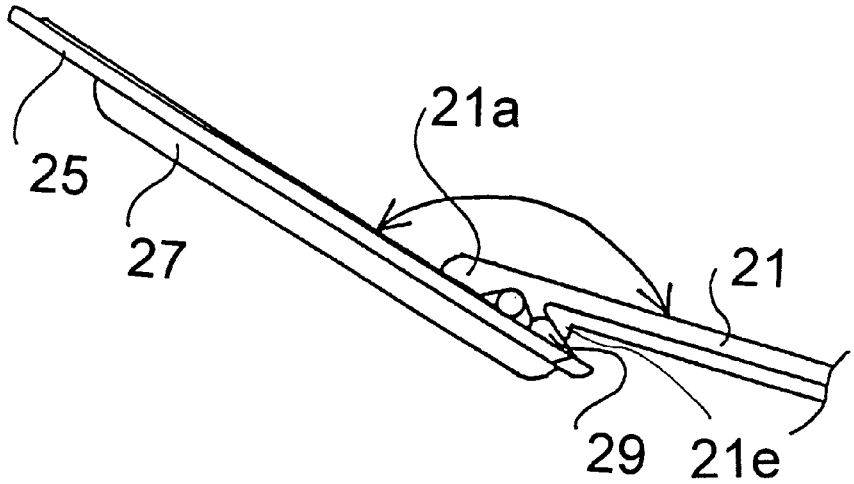
FIG. 6(*a*) is an enlargement of the essential part of the vertical section view showing paper tray 20 of FIG. 5.
Figure 6B:
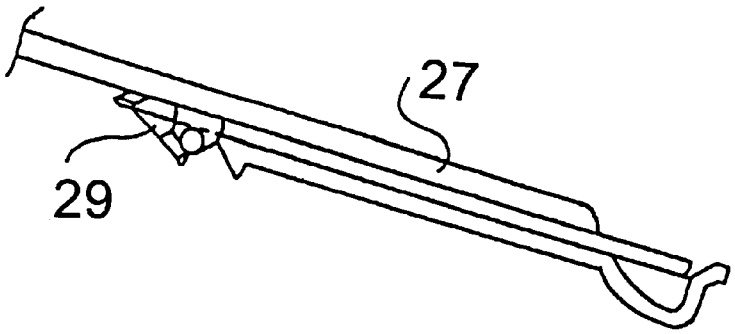

The document tray 20 is described below. FIG. 3 is a perspective view of a paper tray 20 of the document transport device shown in FIG. 1, and FIG. 4 is a perspective view showing the auxiliary tray 25 in a folded state on the top surface of main tray 21 of paper tray 20. FIG. 5 is a vertical section view of paper tray 20 with auxiliary tray 25 of FIG. 3 in an open state. FIG. 6(*a*) is an enlargement of the essential part of FIG. 5, and FIG. 6(*b*) is an enlargement of the essential part of paper tray 20 with auxiliary tray 25 in a closed state.

Figure 7A:
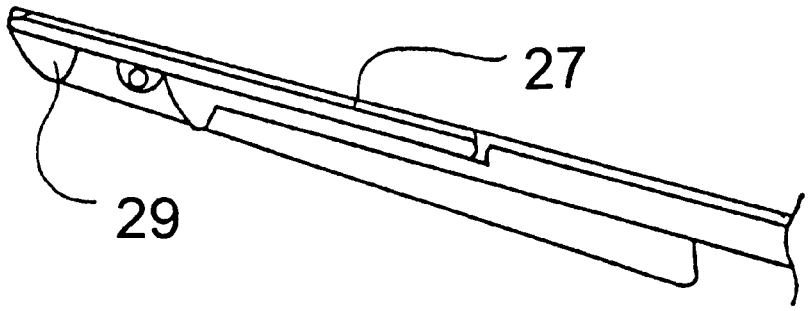
FIG. 7(*a*) shows auxiliary tray 25 in a closed state in another embodiment.
Figure 7B:
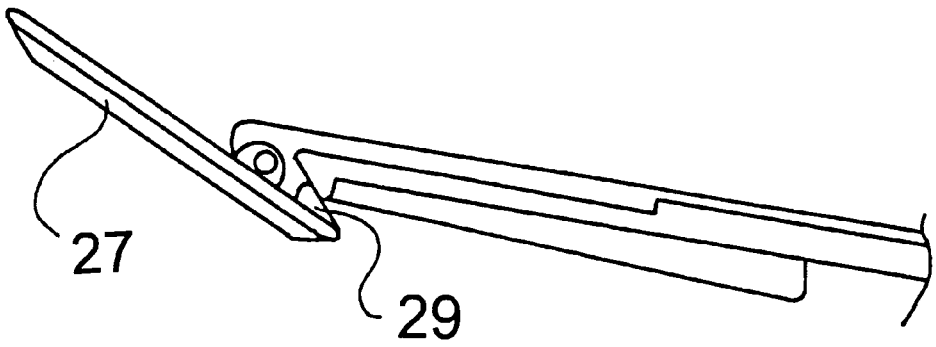

FIGS. 7(*a*) and 7(*b*) are vertical section views showing another embodiment of paper tray 20 of FIG. 5; FIG. 7(*a*) shows auxiliary tray 25 in a closed state, and FIG. 7(*b*) shows auxiliary tray 25 in an open state. In this embodiment, a rib 27 formed on the back surface of auxiliary tray 25 is provided across the entire surface of the auxiliary tray in the length direction.

Figure 8:
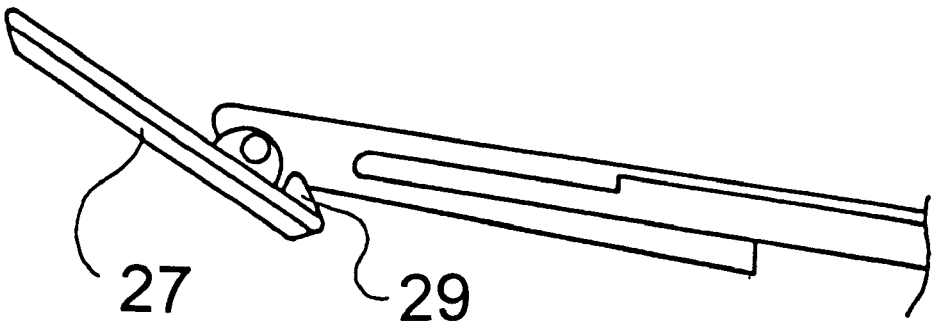
FIG. 8 shows auxiliary tray 25 in an open state in still another embodiment.

FIG. 8 shows still another embodiment.

FIG. 8 shows auxiliary tray 25 in an open state, with the center portion of the leading edge of main tray 21 shorter in the width direction, i.e., rib 29 directly contacts the trailing edge of the main tray in a lateral direction.

The document tray 20 shown in FIGS. 3–8 comprises a main tray 21, and an auxiliary tray 25 mounted near the edge 21*a* on the trailing edge side of main tray 21 so as to be foldable. This arrangement provides a construction which divides document tray 20 into a main tray 21 and auxiliary tray 25 to reduce the surface area of document tray 20 when folded, so as to allow easy manual removal of documents accommodated in discharge tray 35 which is positioned below document tray 20. In this construction, "leading edge" refers to the direction of document transport (i.e., to the right in the drawing), and "trailing edge" refers to the opposite direction (i.e., to the left in the drawing).

Main tray 21 is integratedly mounted on the body of the document transport device such that the edge 21*b* on the leading edge side is connected to the entrance 31*a* of the first U-turn path formed by guide 31 and the like. The leading edge side of main tray 21 is formed with a width equal to the entrance 31*a* of the first U-turn path, and the part from the trailing edge has a gradually narrower width from inclined part 21*c*.

Pins 21*d* and 21*d* provided on bilateral edges in the width direction of edge 21*a* on the trailing edge side of main tray 21 are inserted into receiving hole panels 25*d* and 25*d* provided at corresponding positions on auxiliary tray 25, such that auxiliary tray 25 is rotatably supported by main tray 21 via said receiving hole panels 25*d* and pins 21*d*, so as to allow auxiliary tray 25 to be folded onto the top surface of main tray 21.

The rotational angle of auxiliary tray 25, i.e., the maximum opening angle, is stipulated by the plurality of ribs 29 arrayed in a row in the width direction in the edge of the trailing edge side (facing upward when auxiliary tray 25 is in the open state) which abut protrusions 21*e* provided at corresponding positions on the edge on the trailing edge side of the back surface of main tray 21, as shown in FIGS. 6(*a*) and 7(*b*). In the case of main document tray 20, the aforesaid ribs 29 and protrusions 21*e* are provided so as to provide a maximum opening angle of auxiliary tray 25 of 165°. The number of ribs 29 naturally include the case of only one in the center of the width direction, the case of one at each bilateral side in the width direction, and preferably the case of three or more ribs disposed at equal spacing. The width of rib 29 is optional, and it is possible to substitute rib 29 with a single projecting member extending in the width direction.

When auxiliary tray 25 is folded, the aforesaid ribs 29 function to guide the leading edge of a document ejected from outlet 33*a* of the second U-turn path and reliably collect said document on discharge tray 35. That is, 35 even when the leading edge of a document curls upward when ejected from outlet 33*a* of the second U-turn path, the ribs 29 change the direction of the leading edge of a document downward through contact with the bottom surface of ribs 29 reliably collect said document in the discharge tray via induction. This function is possible because the ribs 29 are positioned in front of projections 21*e* of the edge on the trailing edge side of the back surface of main tray 21, and in front of the gap (i.e., a gap produced when auxiliary tray 25 is in a folded state and dependent on the shape of main tray 21 and auxiliary tray 25) produced near the connection between main tray 21 and auxiliary tray 25, such that the ribs 29 are concealed from the leading edge of the document.

A rib (projection) 27 is provided in the document transport direction in the center in the width direction on the back surface (i.e., the surface facing upward when auxiliary tray 25 is in the closed state) of auxiliary tray 25. This rib 27 functions to lift documents stacked on the back surface of auxiliary tray 25 from other parts (i.e., parts other than said rib 27) of said back surface when used integratedly with main tray 21 with auxiliary tray 25 folded. Therefore, even when manually removing documents stacked on trays 21 and 25, said documents can easily removed by inserting a finger into the gap formed by the lifting of the document.

When auxiliary tray 25 is open, it functions to guide the leading edge of a document ejected from the outlet 33*a* of the second U-turn path, and reliably collect said document in discharge tray 35. That is, even when the leading edge of a document curls upward when ejected from the outlet 33*a* of the second U-turn path, the rib 27 functions to change the direction of the leading edge of said document downward via contact with the bottom surface of rib 27 and reliably collect said document in the discharge tray 35 in the same manner as ribs 29. Furthermore, since rib 27 is formed as a projection, the contact surface area between the rib 27 and the document when guiding the leading edge of a document is smaller than when rib 27 is absent. Therefore, friction resistance is minimized, making collection in the discharge tray more readily accomplished.

According to the embodiments described above, one or two or more projections are formed along the back surface of the auxiliary tray in the document transport direction, such that when the auxiliary tray is folded closed, the documents stacked on the back surface thereof are lifted from said back surface by means of said protrusion, thereby allowing easy manual removal of even small size documents from the feed tray. Furthermore, when the auxiliary tray is open, jams caused by buckling and bending of a document in the gap and height differential in the border between the main tray and the auxiliary tray are prevented because the leading edge of a document ejected from the second U-turn path is guided to the discharge tray by said projection.

In the embodiments described above, a projection is formed on the surface of the auxiliary tray on an edge on the side on which the auxiliary tray is mounted on the main tray, such that when the auxiliary tray is folded closed, jams caused by buckling and bending of a document in the gap and height differential in the border between the main tray and the auxiliary tray are prevented because the leading edge of a document ejected from the second U-turn path is guided to the discharge tray by said projection. In the first and second embodiments, the opening angle of the auxiliary tray can be maintained at a predetermined angle when said auxiliary tray is open by the aforesaid projection abutting a corresponding position on the back surface of the main tray.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

We claim:

1. A feed tray for use in a document transport device which feeds a document in a document transport direction from the feed tray through a first U-turn path and places the document on a document table positioned below said feed tray, and subsequently transports said document in the document transport direction through a second U-turn path and ejects said document to a discharge tray positioned above said document table and below said feed tray, said feed tray comprising:

a main tray having a leading edge disposed to connect with an entrance to said first U-turn path; and an auxiliary tray mounted to a trailing edge of said main tray so as to be foldable onto a top surface of said main tray, said auxiliary tray having a back surface with at least one projection that lifts documents stacked on the back surface of said auxiliary tray when said auxiliary tray is in a folded state, and guides a leading edge of a document from said second U-turn path toward said discharge tray when said auxiliary tray is in an open state.

2. A feed tray according to claim 1, wherein the at least one projection on the back surface of said auxiliary tray is oriented along the document transport direction.

3. A feed tray according to claim 2, wherein said at least one projection comprises a plurality of projections.

4. A document transport device which feeds a document in a document transport direction from a feed tray through a first path and places the document on a document table positioned below said feed tray, and subsequently transports said document in the document transport direction through a second path and ejects said document to a discharge tray positioned above said document table and below said feed tray, the feed tray having a main tray with a leading edge connected to an entrance to said first path, and having an auxiliary tray mounted to a trailing edge of said main tray so as to be folded onto a top surface of said main tray, and said auxiliary tray having a projection provided on a surface on which documents are stacked when said auxiliary tray is in a folded state.

5. A document transport device according to claim 4, wherein the projection formed on the surface of said auxiliary tray is formed on an entire surface in the document transport direction.

6. A document transport device according to claim 4, wherein the projection formed on the surface of said auxiliary tray is a single projection facing along the surface in the document transport direction.

7. A feed tray for use in a document transport device which feeds a document in a document transport direction from the feed tray through a first U-turn path and places the document on a document table positioned below said feed tray, and subsequently transports said document in the document transport direction through a second U-turn path and ejects said document to a discharge tray positioned above said document table and below said feed tray, said feed tray comprising:

a main tray having a leading edge disposed so as to connect with an entrance to said first U-turn path; and an auxiliary tray mounted to a trailing edge of said main tray so as to be foldable onto a top surface of said main tray, and provided with at least one projection on a surface of the auxiliary tray that guides a leading edge of the document from said second U-turn path toward said discharge tray when said auxiliary tray is in a folded state, and controls an opening angle between said auxiliary tray and said main tray by abutting a predetermined position on said main tray when said auxiliary tray is in an open state.

8. A feed tray according to claim 7, wherein said at least one projection of said auxiliary tray is oriented along a direction perpendicular to the document transport direction.

9. A feed tray according to claim 7, wherein said at least one projection comprises a plurality of projections.

10. A feed tray according to claim 7, further comprising a protrusion which is provided at a position abutting at least one projection of the auxiliary tray when said auxiliary tray is in the open state.

11. A document transport device which feeds a document in a document transport direction from a feed tray through a first path and places the document on a document table positioned below said feed tray, and subsequently transports said document in the document transport direction through a second path and ejects said document to a discharge tray positioned above said document table and below said feed tray, said feed tray having a main tray with a leading edge connected to an entrance to said first path, and having an auxiliary tray mounted to a trailing edge of said main tray so as to be foldable onto a top surface of said main tray, and said auxiliary tray having at least one projection provided on a surface on which documents are stacked when said auxiliary tray is in a folded state, said at least one projection guides a leading edge of a document from said second path toward said discharge tray when said auxiliary tray is in an open state, and controls an opening angle between said auxiliary tray and said main tray by each projection abutting a corresponding position on a back surface of said main tray when said auxiliary tray is in the open state.

12. A document transport device according to claim 11, wherein the at least one projection of said auxiliary tray is oriented along the document transport direction.

13. A document transport device according to claim 11, wherein said at least one projection comprises a plurality of projections.

14. A document transport device according to claim 11, further comprising a protrusion which is provided at a position abutting at least one projection of the auxiliary tray when said auxiliary tray is in the open state.

* * * * *